United States Patent [19]

Gelling

[11] 4,212,554

[45] Jul. 15, 1980

[54] PAPER-FEEDING APPARATUS FOR A PRINTER

[75] Inventor: Helmut Gelling, Wangen, Switzerland

[73] Assignee: Firma Precisa AG Rechenmaschinenfabrik, Zurich, Switzerland

[21] Appl. No.: 874,564

[22] Filed: Feb. 2, 1978

[30] Foreign Application Priority Data

Feb. 14, 1977 [DE] Fed. Rep. of Germany ..... 2706161

[51] Int. Cl.[2] ..... B41J 19/76

[52] U.S. Cl. ..... 400/550; 400/568; 400/569; 400/577; 400/636; 400/641

[58] Field of Search ..... 400/549, 550, 565, 567, 400/568, 569, 577, 611, 613.1, 632, 636, 636.2, 641, 902; 74/339, 436

[56] References Cited

U.S. PATENT DOCUMENTS

| | | | |
|---|---|---|---|
| 1,887,401 | 11/1932 | Denton et al. | 400/636 X |
| 2,353,407 | 7/1944 | Kurowski | 400/636 X |
| 2,788,108 | 4/1957 | Winter et al. | 400/550 |
| 3,960,258 | 6/1976 | Aebi | 400/569 X |

*Primary Examiner*—Ernest T. Wright, Jr.

*Attorney, Agent, or Firm*—Burns, Doane, Swecker & Mathis

[57] ABSTRACT

A printer includes a paper transport cylinder which is intermittently driven by a motor to automatically advance the paper by one line each time a line has been printed. In order to advance the paper before printing begins a manually actuable key is provided which, when depressed, couples the transport cylinder to the motor and actuates the motor. The transport cylinder is rotated while the key is depressed to rapidly advance the paper.

3 Claims, 4 Drawing Figures

PAPER-FEEDING APPARATUS FOR A PRINTER

BACKGROUND AND OBJECTS OF THE INVENTION

The invention concerns a paper-feeding apparatus for a printer of the type where each time after one line is printed the paper is advanced automatically by the space of one line.

Such a printer typically comprises a main shaft which is turned by a drive motor for the printing operation and which carries a paper-transport cylinder freely rotatable and axially fixed. A pressure roller presses the paper elastically against the perimeter of the transport cylinder. A coupling wedge is provided which is axially movable and which rotates together with the main shaft. The wedge can be forced, counter to the elastic bias of a restoring spring, from an unencumbered position into recesses on the paper transport cylinder by a cam control to rotate the paper transport cylinder.

In the case of printers with paper-feeding devices of this type it becomes necessary, whenever a new paper roll is inserted or the printed portion of the paper is torn off, to advance the paper in the blank state (i.e., without printing) for several spaces. This operation in many cases is carried out by a handwheel which is turned for the purpose of advancing the paper, the handwheel being located at the side and coupled to the paper-transport cylinder. Alternatively, the printer must go through several printing cycles without positioning of the type in order to advance the paper by the necessary number of lines and thus utilizing the regular step-by-step feeding mechanism. The first solution requires special efforts by the operator while the second possibility takes a relatively long time to accomplish.

It is, therefore, the object of the invention, to utilize the available motor drive of the printer for a rapid blank feed of the paper as desired, and to accomplish this operation mainly by the use of components which are already provided for the step-by-step advance, in other words, without significantly increasing the number of parts of the printer.

BRIEF SUMMARY OF INVENTION

The invention achieves this object in that the coupling wedge carries a radial projection which engages a control disk which is movable in axial direction of the main shaft at each transverse pitch of the wedge. The control disk is moved by a key to displace the wedge into a recess of the transport cylinder. The key activates the motor switch to rotate the shaft.

This arrangement utilizes, for a desired rapid paper feed, only components of the paper-feeding apparatus which are provided for the step-by-step advance, the sole exceptions being the disk and key. With the paper-transport cylinder being coupled rigidly with the main shaft so long as the key is depressed, there is attained a rapid advance of the paper. The components which are needed additionally can be installed in a very simple manner and do not take up much space and can therefore be accommodated for all practical purposes inside the printer without dimensional changes.

It will be advantageous if the movable control disk encloses, with sliding fit, the cam plate. For the purpose of cam control the cam plate is arranged coaxially to the main shaft, is stationary, and carries axial cams. The control disk can also have a first projection, supported against the frame of the printer, and a second projection, substantially diametrically opposed to the first projection. The latter is engaged by an inclined ramp surface which is connected with a push-button slide of the key. The push-button slide is pushed by a spring into the nonengaging position of its inclined surface.

THE DRAWING

The invention will be explained in detail by the use of a preferred practical example and in connection with the drawing wherein.

DETAILED DESCRIPTION OF A PREFERRED EMBODIMENT OF THE INVENTION

Figure 1:
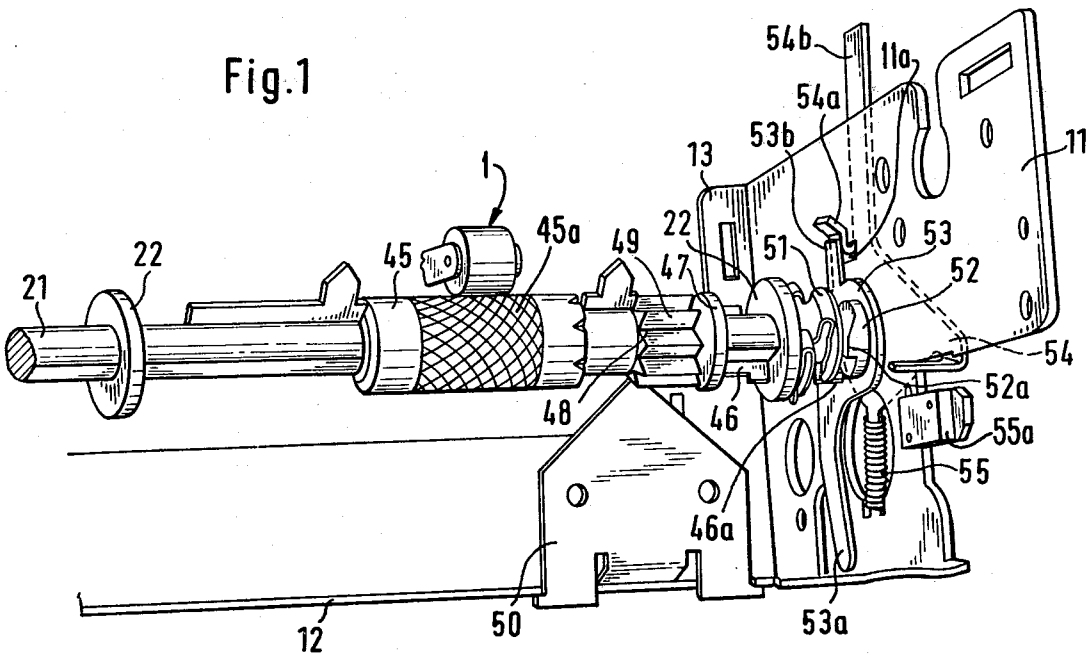
FIG. 1 shows the main shaft of the printer with paper-feeding apparatus and its connection with one of the sides of the printer, with other portions of the printer omitted.

FIG. 1 provides a prespective and cutaway view of the parts of the printer which are essential for the invention. There is shown a side wall 11 of the frame of the printer. One end of a main shaft 21 of the printer is mounted within the wall 11 in the usual manner. Eccentric disks 22, needed for the printer drive are located fixedly on the shaft 21. The actual printer, the section illustrated herein representing one portion of the same, is described in detail in German Patent Application No. P 27 05 435.9. These details are immaterial in this specific case and a description would only be repetitive. Attention may be directed to the above-referenced German patent application for further description.

On the main shaft 21 a paper-transport cylinder 45 is mounted axially immovably. The cylinder 45 has a knurled circumferential area **45*a* to improve friction. Paper, which is to be guided over the paper-transport cylinder 45 is forced against the paper-transport cylinder 45 by means of a conventional pressure roller 1. The pressure roller 1** is spring-loaded and rests against one portion of the frame of the printer in the usual manner.

Figure 2:
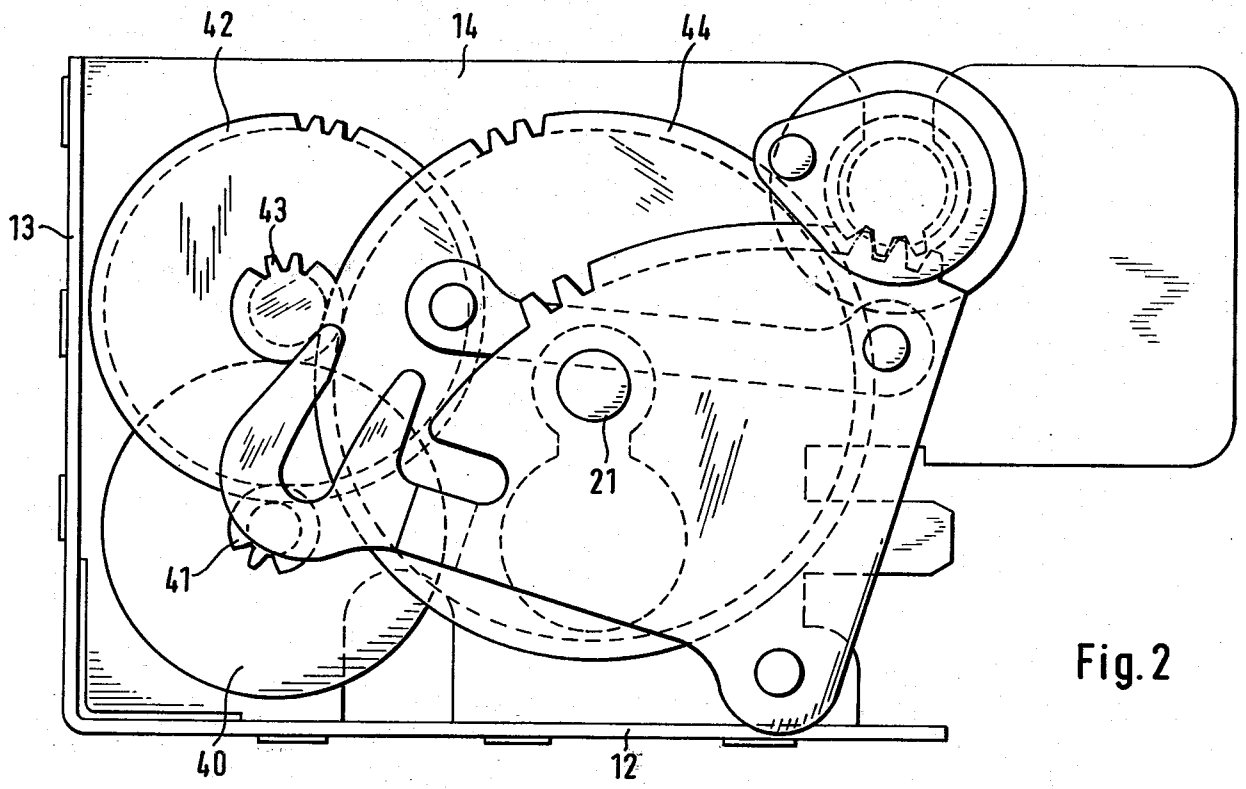
FIG. 2 illustrates the drive connection between the motor and the main shaft of the printer.
Figure 3:
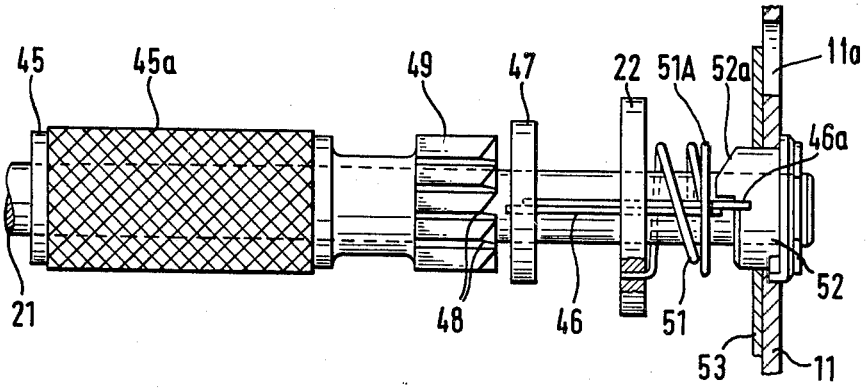
FIG. 3 is a fragmentary view depicting a manually shiftable wedge element of the printer in a rest position.

The main shaft 21 is driven by way of a gearing, shown in FIG. 2, by an electromotor 40, held in place within the frame of the printer. The drive side of the main shaft 21 seats in the outer side of the wall 14 which is opposed to the wall 11 of the frame illustrated in FIG. 1. The side walls 11 and 14 of the frame are connected with each other by the frame base 12 and the frame rear wall 13, among other connecting parts. The motor 40 carries on its shaft a pinion 41 which engages an idler gear 42 which is rotatably supported on the wall 14. The idler gear 42 in turn is rigidly connected with another pinion 43 which is engaged by the toothed wheel 44, mounted on the main shaft 21. The other gearing components depicted in FIG. 2 are not relevant to the presently discussed invention and are therefore not described in detail.

A coupling wedge 46 is provided which is axially movable relative to the main shaft 21 but rotates therewith. The wedge 46 is connected to the shaft 21 in that it is slidably mounted withint slots **22*a* in the right-hand eccentric disk 22 and within slots 22*b*** in a slotted disk 47, the latter being fixedly connected to the main shaft 21. The wedge 46 can be axially inserted into recesses 48 arranged at a wedge-facing front end of the transport cylinder 45, to form a rotary coupling between main shaft 21 and paper-transport cylinder 45. The transport cylinder 45 also carries on an axially delimited circumferential sector notches 49 which are engaged by a stop spring 50 that is fastened to the frame. The spring 50 holds the paper-transport cylinder 45 in place at certain specific positions which correspond to the single lines of advancement of the paper to be printed. The wedge 46 is normally prevented from engaging the recesses 48 by a leaf spring 51 which rotates jointly with the wedge 46 and the shaft 21. The spring 51 is connected to the disk 22 and bears against a ring 51A, the latter engaging within a notch 51B of the wedge 46 to urge the wedge 46 away from the recesses 48. In so doing, one end of the wedge 46 rests against a cam plate 52 having axially protruding cams 52*a*.

The cam plate 52 is surrounded with sliding fit by a control disk 53 which can move back and forth on the circumferential surface of the cam plate 52.

The control disk 53 is normally pressed by a radial projection 46*a* of the wedge 46 against the wall 11 of the frame by a force of the wedge-restoring spring 51. The control disk 53 is provided with a first projection 53*a* which rests against the wall 11 of the frame and with a second projection 53*b*. The latter extends substantially diametrically opposite the first projection 53*a*. Within the wall 11 of the frame there is arranged a slotted opening 11*a* which is aligned with the projection 53*b* and through which extends a finger 54*a* of a push-button slide 54. This finger 54*a* engages the upper end of the second projection 53*b*. The finger 54*a* is configured in the form of a ramp-like inclined surface. The push-button slide 54 is mounted, vertically movable, on the outer side of the wall 11 of the frame. The lower end of the slide 54 seats within a helical compression spring 55 mounted on the side wall 11 of the frame. Thus, the slide 54, when at rest, is in its extreme upper position. An upper end 54*b* of the slide 54 preferably is provided with a key 54*c* to be operated by the finger of an operator.

IN OPERATION, during the regular step-by-step advance of the printing process the end of the wedge 46, which is forced against the cam plate 52 by the spring 51, slides across the surface of the plate 52 and thus eventually also across the axial control cam 52*a*. The cam 52*a* forces the wedge 46 into one of the recesses 48 of the transport cylinder 45. The wedge 46 rotates this cylinder 45 until the wedge 46 reaches the end of the control cam 52*a* and leaves the recess 48 by springing back into its normal position. The transport cylinder 45 has thus been advanced by one pitch of the notches 49 and will be held in this position by the stop spring 50.

Figure 4:
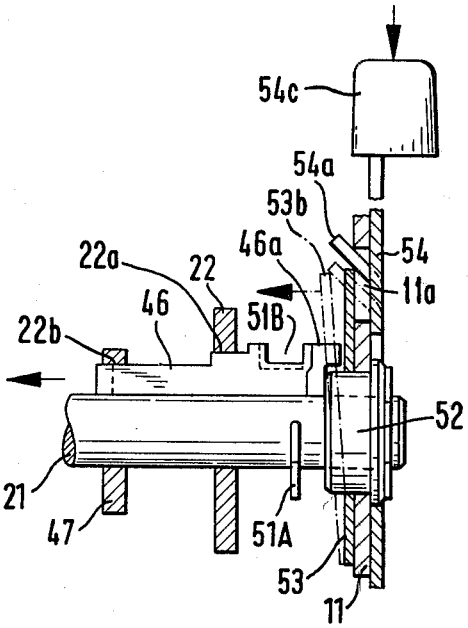
FIG. 4 is a partial view of the FIG. 3 mechanism, with a spring removed and depicting in broken lines the wedge element being manually displaced.

For the purpose of rapid paper transport the operator pushes the key 54*c* down, thereby moving the push-button slide 54 downwardly against the force of the spring 55. The finger projection 54*a*, provided with a ramp-like surface, now axially displaces the projection 53*b* and thereby axially displaces the entire control disk 53, as depicted in broken lines in FIG. 4. In other words, the projection 54*a* pushes the disk 53 (which is slidably carried on the outer perimeter of the cam plate 52) away from the wall 11 of the frame in the axial direction of the main shaft 21. The disk 53, in turn, engages the radial projection 46*a* of the wedge 46 and pushes the wedge 46 into one of the recesses 48, thereby coupling the transport cylinder 45 with the main shaft 21. The push-button slide 54, in addition, energizes a microswitch 55*a* to actuate the motor 40. Accordingly, the main shaft 21 rotates until the key 54*c* is released. At the moment of release the key 54*c*, biased by the spring 55, springs upwardly, the microswitch 55*a* is deenergized and the control disk 53 returns to its original rest position. The latter movement is accomplished by the spring action of spring 51 acting through the radial projection 46*a* of the wedge 46. The stop spring 50 further insures that the transport cylinder 45 occupies a specific, defined position, and the paper will now be in position for the first printed line of the next printing operation.

The specific placement and the design of the components are obviously shown in the form of one preferred example only, and can be modified within the framework of the invention to meet special conditions and circumstances with respect to the printer. The description of the practical example given shows clearly however, that by the use of very few and simple components, which require very little space, a rapid paper advance has been created which utilizes the standard step-by-step transport system of the printer and which can be operated with ease.

Although the invention has been described in connection with a preferred embodiment thereof, it will be appreciated by those skilled in the art that additions, modifications, substitions and deletions not specifically described may be made without department from the spirit and scope of the invention as defined in the appended claims.

What is claimed is:

1. In a printer comprising a drive motor, a main shaft rotatably connected to said drive motor, a paper transport cylinder freely rotatable and axially fixed on said shaft, a coupling wedge axially movable on said shaft and rotatable with said shaft, a cam member, spring means urging said wedge against said cam member such that during a printing operation said cam member displaces said wedge into engagement with a recess in said paper transport cylinder to automatically advance paper by one line each time a line has been printed, the improvement wherein:

a control disk is mounted for movement in the axial direction of said shaft;

said wedge including a projection engageable with said control disk;

a key mounted for manual actuation, said key including a portion for displacing said control disk axially to displace said wedge axially into engagement with said recess in said paper transport cylinder, said key being operable, when actuated, to activate said motor to rotate said shaft and thereby rotate said paper transport cylinder by means of the wedge which drivingly couples said shaft to said transport cylinder.

2. Apparatus according to claim 1, wherein said disk is slidably mounted on said cam member, said cam member being stationary and situated coaxially relative to said shaft, said cam member carrying axially projecting cams.

3. Apparatus according to claim 2, wherein said control disk includes a first projection supported against a frame of the printer, and a second projection located substantially diametrically opposite said first projection; said displacing portion of said key comprising an inclined ramp which is engageable with said second projection to swing said disk about a fulcrum defined by a place of contact between said first projection and said frame, said key including a manually actuable portion, and a spring being provided for biasing said key to a position where said inclined ramp does not swing said disk.

* * * * *